US011676781B1

(12) United States Patent
Ziegler, IV

(10) Patent No.: US 11,676,781 B1
(45) Date of Patent: Jun. 13, 2023

(54) INRUSH CURRENT LIMITING ENABLED SWITCH

(71) Applicant: Dell Products L.P., Round Rock, TX (US)

(72) Inventor: Charles W. Ziegler, IV, Framingham, MA (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/727,466

(22) Filed: Apr. 22, 2022

(51) Int. Cl.

| | |
|---|---|
| ***H01H 15/04*** | (2006.01) |
| ***H01H 3/02*** | (2006.01) |
| ***H01H 15/10*** | (2006.01) |
| ***H01H 1/48*** | (2006.01) |
| ***H01H 1/36*** | (2006.01) |
| ***H01H 1/58*** | (2006.01) |

(52) U.S. Cl.
CPC ..... *H01H 15/10* (2013.01); *H01H 1/365* (2013.01); *H01H 1/48* (2013.01); *H01H 1/58* (2013.01); *H01H 3/0213* (2013.01); *H01H 15/04* (2013.01)

(58) Field of Classification Search
None
See application file for complete search history.

(56) References Cited

U.S. PATENT DOCUMENTS

| | | | | |
|---|---|---|---|---|
| 3,996,431 | A * | 12/1976 | Brown | H01H 15/04 200/284 |
| 4,675,540 | A * | 6/1987 | Conaway | H01H 23/164 307/115 |
| 7,093,048 | B2 | 8/2006 | Bobbitt et al. | |
| 7,360,288 | B2 * | 4/2008 | Takao | B60R 22/48 200/61.58 B |
| 7,728,240 | B2 * | 6/2010 | Dodal | H01H 15/06 200/252 |
| 8,869,357 | B2 * | 10/2014 | Midorikawa | A44B 11/2523 24/640 |
| 9,513,681 | B2 | 12/2016 | Wang et al. | |
| 9,959,996 | B2 | 5/2018 | Casparian et al. | |
| 10,177,554 | B2 | 1/2019 | Wu et al. | |
| 11,342,138 | B1 * | 5/2022 | Chen | H05K 1/0296 |
| 2009/0174386 | A1 | 7/2009 | Popescu et al. | |
| 2015/0332876 | A1 * | 11/2015 | Kikuchi | H01H 15/10 200/16 R |
| 2018/0234025 | A1 | 8/2018 | Gharpure et al. | |

* cited by examiner

*Primary Examiner* — Felix O Figueroa
(74) *Attorney, Agent, or Firm* — Larson Newman, LLP

(57) ABSTRACT

A switch includes an actuator for moving the switch from an OFF position to an ON position. A resistor is connected in series between a first terminal and a second terminal, and limits inrush current that flows when the switch is moved from the OFF position to the ON position.

20 Claims, 4 Drawing Sheets

INRUSH CURRENT LIMITING ENABLED SWITCH

FIELD OF THE DISCLOSURE

The present disclosure generally relates to switches, and more particularly relates to an inrush current limiting enabled switch.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus, information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems. Information handling systems can also implement various virtualized architectures. Data and voice communications among information handling systems may be via networks that are wired, wireless, or some combination.

SUMMARY

A switch includes an actuator for moving the switch from an OFF position to an ON position. A resistor is connected in series between a first terminal and a second terminal, and limits inrush current that flows when the switch is moved from the OFF position to the ON position.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings and is provided to assist in describing the teachings. This focus should not be interpreted as a limitation on the scope or applicability of the teachings.

An information handling system typically requires power to operate. Such power is supplied by a power supply unit. To provide clean and stable power, the power supply unit typically includes a bulk capacitor, such as an electrolytic capacitor to serve as a reservoir of electric charge. When switching on power to high capacitive loads there is a relative and proportional inrush current associated with that capacitance. The inrush current can over-stress the internal input components of the information handling system.

In addition to an information handling system, other systems or components may require a switch to enable power distribution to end devices. Many of these systems require limiting the inrush current to not overburden the power regulators that have a set current limit as well as exceed the copper current carrying capabilities. With today's systems or components such as drives and backplanes, there are custom integrated circuits that are used to limit current such as soft start integrated circuits, load switches with current limiting features, or programmable current limit integrated circuits. These integrated circuits are expensive and add to the cost of materials to build and take up board space. Accordingly, the present disclosure provides an inrush current limiting enabled switch to address these and other problems.

Figure 1:
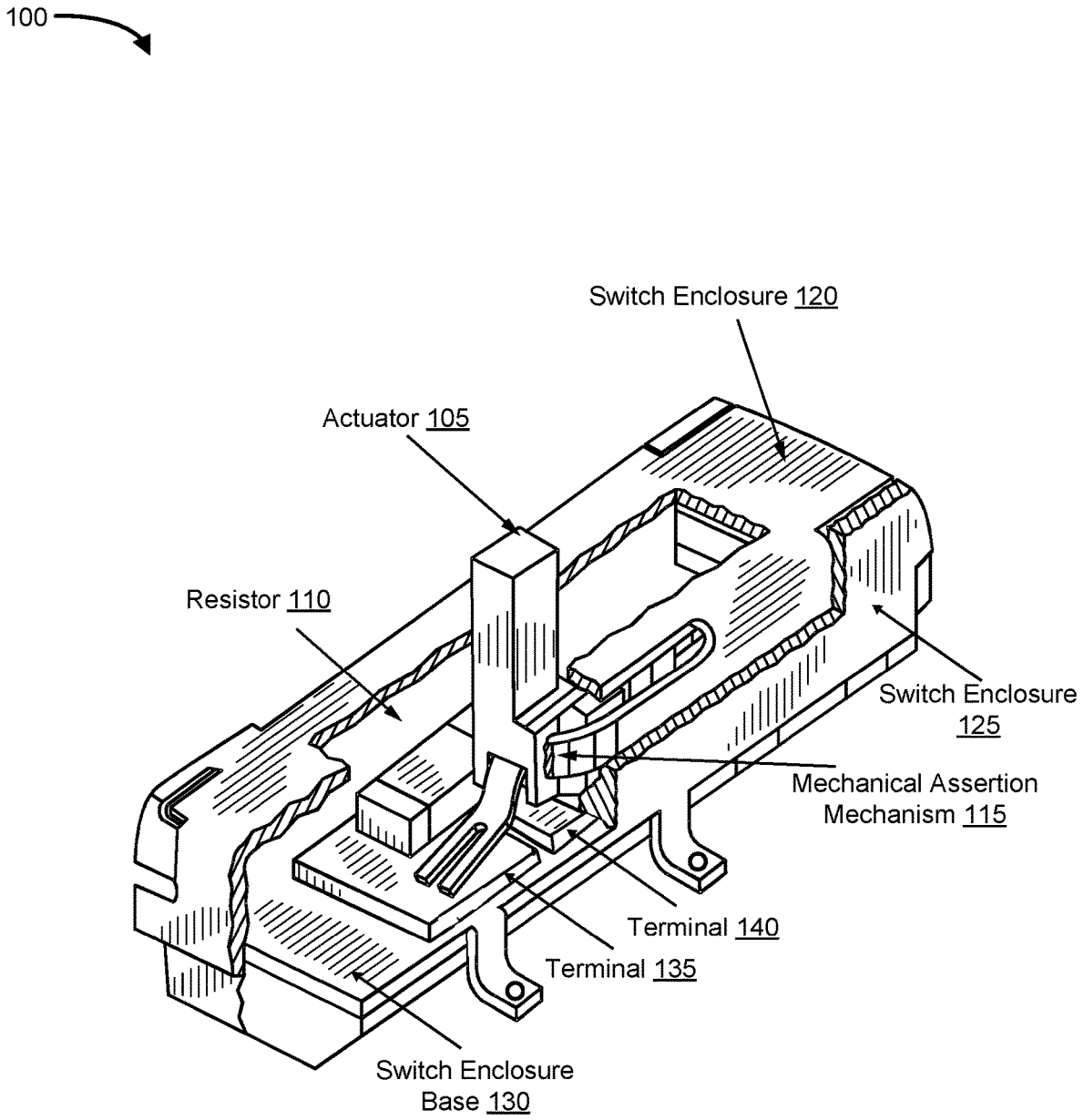
FIG. 1 is a perspective diagram cut away to show an interior of a switch configured for limiting inrush current according to an embodiment of the present disclosure.

FIG. 1 shows the interior of an inrush current limiting enabled switch 100. Switch 100, which may be an electrical or an electronic switch, includes an actuator 105, a resistor 110, a mechanical assertion mechanism 115, a switch enclosure 120, a switch enclosure 125, a switch enclosure base 130, a terminal 135, and a terminal 140. Switch enclosure 120 is preferably composed of an insulating material such as plastic. Switch enclosure 120 includes a slot on one side such as its top side, and extending from the slot is a lever portion of actuator 105. Switch enclosure 125 is disposed on the outer layer of switch enclosure 120 while switch enclosure base 130 may be located at the bottom of switch 100 to provide support to its components. Actuator 105 is a mechanical component of switch 100 that is attached to sliding contact 205, also referred to as a moving contact, and includes one or more moving contacts. Actuator 105 may be configured to manually move sliding contact 205 from one position to another, such that one or both of its contacts mate with one or more fixed contacts.

Switching on the power typically uses a switch which is an electromechanical device with one or more sets of electrical contacts used to control the flow of electricity in a circuit, such as contacts 250, 255, 260, and contact structures 225 and 230. Typically, a switch has two positions, "ON" and "OFF". In the present disclosure, switch 100 implements a multi-stage mating sequence that may include a first stage, a second stage, and a third stage. The first stage, also referred to as OFF position/state, mates or engages the contacts with a ground. The second stage also referred to as transition position/state, mates or engages the contacts with a pre-charge, such as a twelve-volt pre-charge. The third stage, also referred to as ON position/state, mates or engages the contacts with a high-speed/side-band. The pre-charge and the high-speed/side-band may both be twelve volts each. At the second stage, there is an inrush current limiting resistor inline of a second-to-mate pre-charge voltage pin, such as resistor 110 which enables a soft start for the system or its components such as drives and limits current draw. The remaining voltage is sent to the system or components without the resistor once the switch is in the third stage.

When actuator 100 is moved so that switch 100 goes from the OFF state to the ON state, switch 100 goes through the transition state in between. Mechanical assertion mechanism 115 may be configured to assure that switch 100 does not stay in the transition state. Mechanical assertion mechanism 115 may also be configured to keep or assure that switch 100 does not go back to the OFF state, such that actuator 105 continues to the ON state. Mechanical assertion mechanism 115 may be disposed on a side of actuator 105, and may have a gripping end to keep actuator 105 from staying in the transition state. Mechanical assertion mechanism 115 may also be configured such that when the manual force that moved actuator 105 is removed, mechanical assertion mechanism 115 may apply a leveraged force upon actuator 105 towards the ON state. Similar to switch enclosure 120, mechanical assertion mechanism 115 may be made of insulating material such as plastic. However, mechanical assertion mechanism 115 may be made of a harder material than switch enclosure 120 permitting it to provide such force.

Resistor 110 is a passive electrical component that implements electrical resistance. Resistor 110 may be a power resistor or a negative temperature coefficient resistor and is embedded within switch enclosure 120, such that its placement is used to reduce inrush current flow. Here, resistor 110 is disposed of with terminal 135 and terminal 140, such that it provides a path for electrical flow between the two terminals. For example, one end of resistor 110 is connected to a fixed contact of terminal 135 and another end of resistor 110 is connected to a fixed contact of terminal 140. The details of resistor 110 are known in the art and will not be further described herein, except as may be needed to illustrate the current embodiments.

Figure 2B:
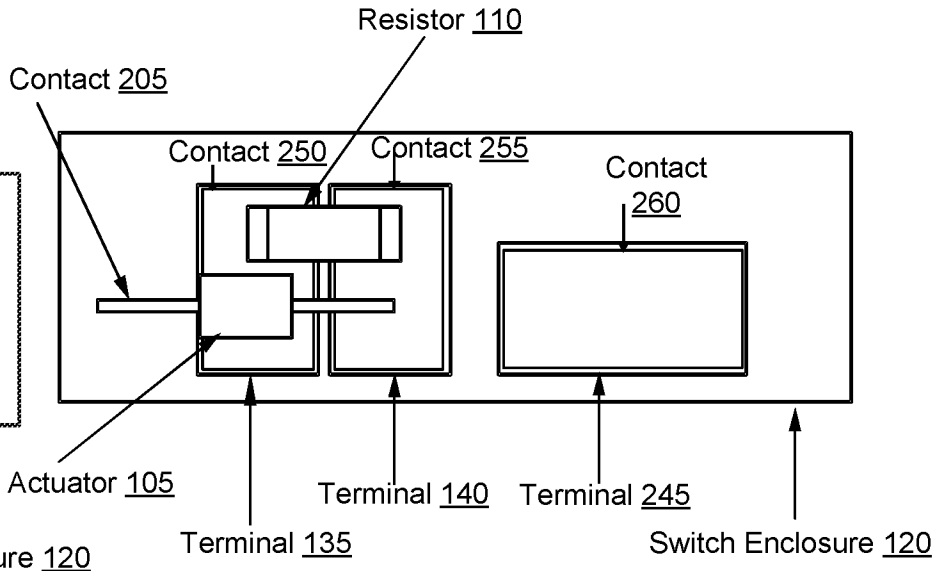
FIG. 2*b* is a top view of an interior of a switch for limiting inrush current, according to an embodiment of the present disclosure.
Figure 2A:
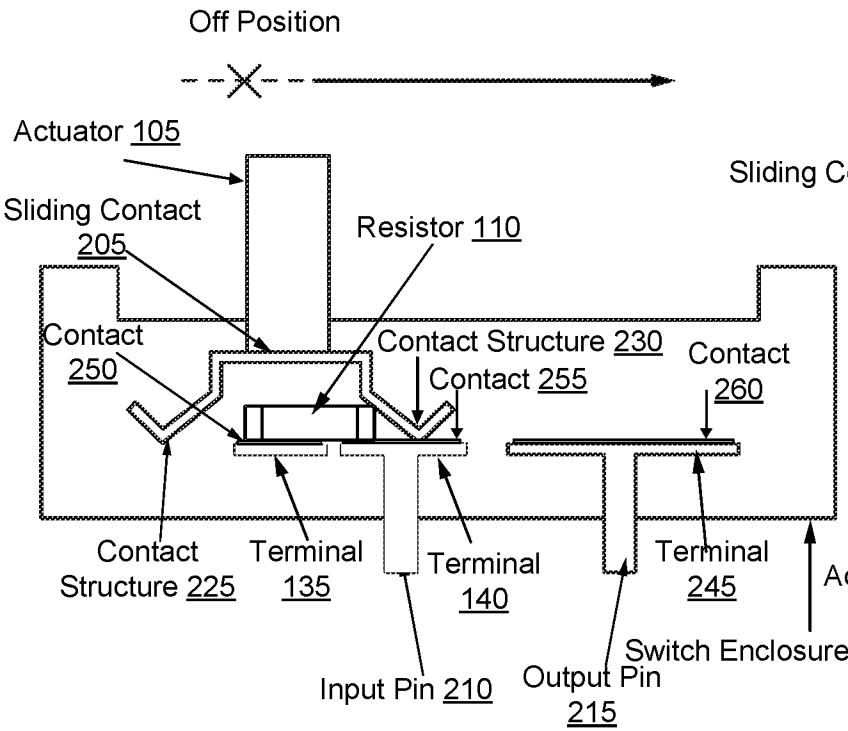
FIG. 2*a* is a side view of an interior of a switch for limiting inrush current, according to an embodiment of the present disclosure.

FIG. 2*a* shows a side view of an interior of switch 100 for limiting inrush current, wherein switch 100 is at an OFF position. FIG. 2*b* shows a top view of the interior of switch 100. When a switch is in an OFF position, a set of contacts are separated and there is no flow of electricity. In addition to the components shown in FIG. 1, switch 100 also includes a sliding contact 205, an input pin 210, an output pin 215, and a terminal 245. Sliding contact 205 includes a contact structure 225 and a contact structure 230. Each terminal includes a fixed contact, such that a contact 250 is mounted on terminal 135 while a contact 255 is mounted on terminal 140 and contact 260 is mounted on terminal 245. Terminal 140 is associated with input pin 210, wherein input voltage is received. Terminal 245 is associated with output pin 215, wherein output voltage is transmitted. The terminals in conjunction with the pins are used to electrically connect the switch 100 a power supply to a circuit and/or a load.

Sliding contact 205 is structured so that contact occurs as it moves against a fixed contact. In this embodiment, sliding contact 205 is constructed such that one or more of the contact structures of sliding contact 205 is brought into contact with one or more fixed contacts. Here, contact structure 225 is not in contact with any fixed contact while contact structure 230 is in contact with a fixed contact associated with terminal 140 which is associated with input pin 210. Input pin 210 is where switch 100 receives input voltage in. Output pin 215 is where switch 100 connects to a load allowing it to be powered on via an output voltage when the switch 100 is in an ON position. As contact structure 225 is not in contact with one of the fixed contacts, there is no complete circuit between input pin 210 and output pin 215 so there is no electrical flow. Switch 100, in particular, input pin 210 and output pin 215 may be constructed to handle voltage requirements of the load or system that switch 100 is used for. As such, although the example of pre-charge and the high-speed/side-band was stated as twelve volts, the pre-charge and high-speed/side-band may be lower or higher than twelve volts.

Figure 3B:
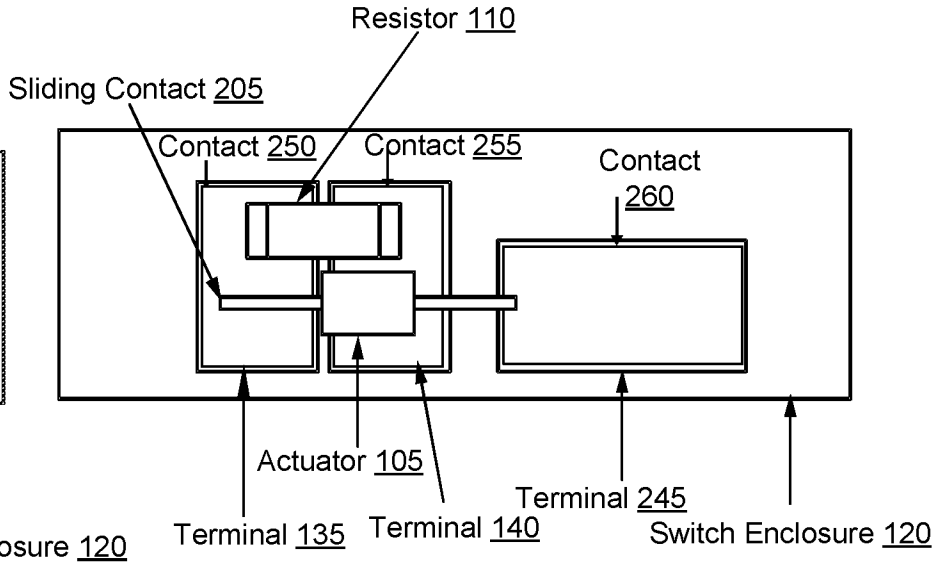
FIG. 3*b* is a top view of an interior of a switch for limiting inrush current, according to an embodiment of the present disclosure.
Figure 3A:
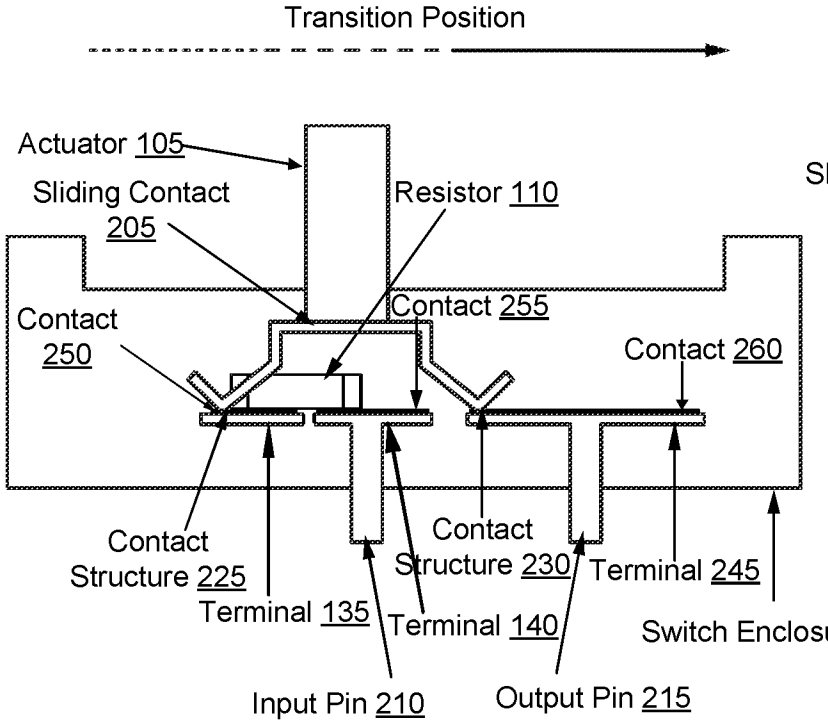
FIG. 3*a* is a side view of an interior of a switch for limiting inrush current, according to an embodiment of the present disclosure.

FIG. 3*a* shows a side view of an interior of switch 100 for limiting inrush current, wherein switch 100 is in a transition position. FIG. 3*b* shows a top view of the interior of switch 100. A manual manipulation used on actuator 105 may have been used to slide or move sliding contact 205 from the OFF position towards the ON position, wherein the transition position is in between the two positions. When switch 100 is in the transition position, contact structure 225 couples or mates with contact 250 while contact structure 230 is in contact with contact 260. As such, there is a connection between input pin 210 and output pin 215 such as current, which may be inrush current, flows from input pin 210 through resistor 110 and then to output pin 215. Because of the placement of resistor 110, which is disposed between or in series with terminal 135 and terminal 140, resistor 110 limits the current draw enabling a soft start for one or more components or devices. Without protection from the inrush current, the components or devices may be overstressed or cause circuit disturbances or failures. The resistance value of resistor 110 may be based on the current/power limitations of the components or devices.

Figure 4B:
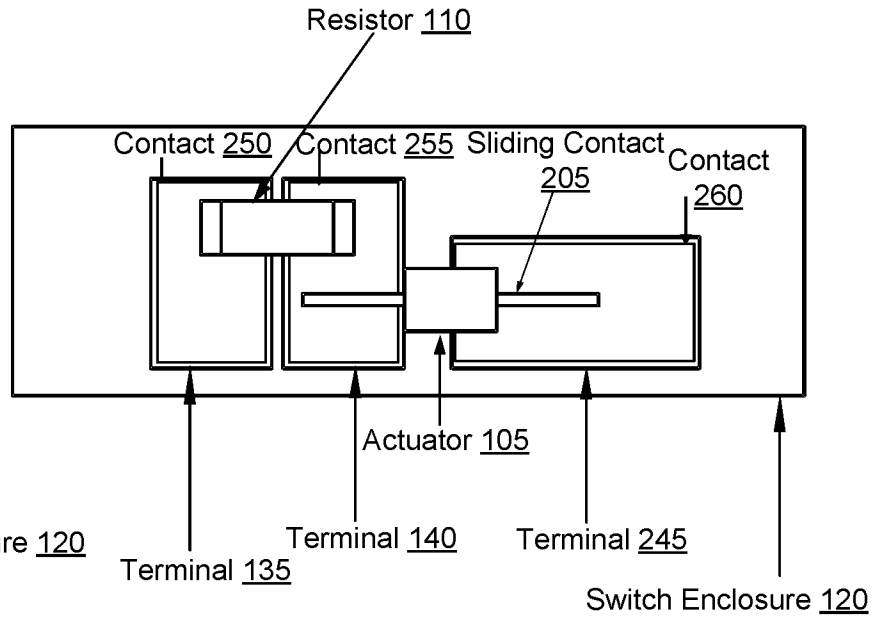
FIG. 4*b* is a top view of an interior of a switch for limiting inrush current, according to an embodiment of the present disclosure.
Figure 4A:
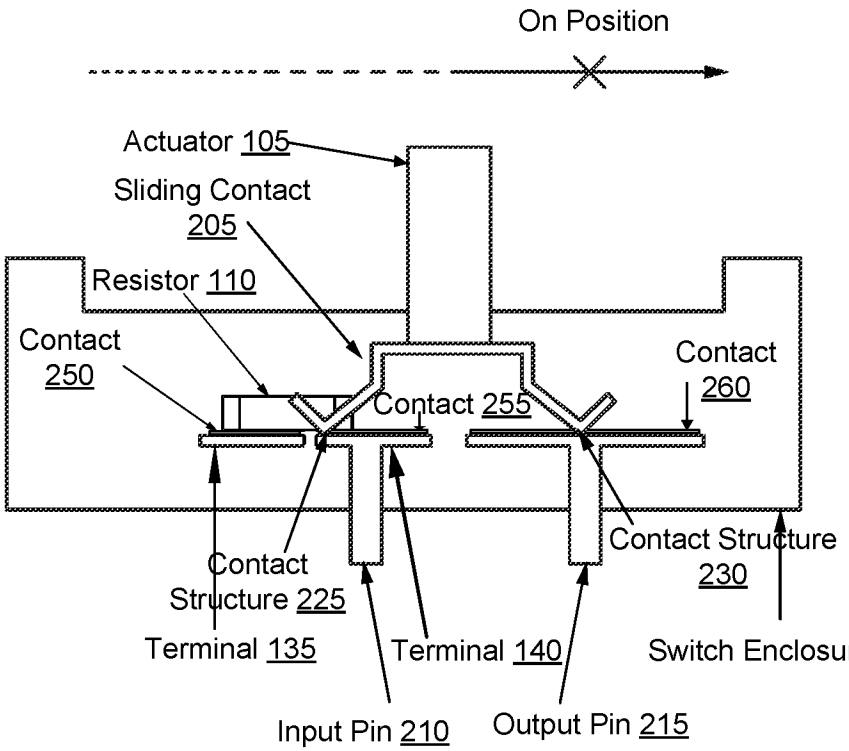
FIG. 4*a* is a side view of an interior of a switch for limiting inrush current, according to an embodiment of the present disclosure.

FIG. 4*a* shows a side view of the interior of switch 100, wherein switch 100 is in an ON position. FIG. 4*b* shows a top view of the interior of switch 100. Manual manipulation may have been used on actuator 105 to slide or move sliding contact 205 from the OFF position to the ON position via the transition position. In an embodiment, a leveraged force may have been applied by mechanical assertion mechanism 115 to push switch 100 from the transition position to the ON position. When switch 100 is in the ON position, contact structure 225 mates with contact 255 while contact structure 230 is in contact with contact 260. As such, there is a connection between input pin 210 and output pin 215 such that current flows between the two pins without going through resistor 110.

Those of ordinary skill in the art will appreciate that the configuration, hardware components of switch 100 depicted in FIG. 1 may vary. For example, the illustrative components within switch 100 are not intended to be exhaustive, but rather are representative to highlight components that can be utilized to implement aspects of the present disclosure. For example, other devices and/or components may be used in addition to or in place of the devices/components depicted.

The depicted example does not convey or imply any architectural or other limitations with respect to the presently described embodiments and/or the general disclosure. In the discussion of the figures, reference may also be made to components illustrated in other figures for continuity of the description. The components shown are not drawn to scale and switch 100 may include additional or fewer components. In addition, connections between components may be omitted for descriptive clarity. Although illustrated as having a rectangular shape, in other embodiments, switch enclosure 120 may have a circular, semi-circular, or sloped shape. In addition, switch 100 may be one of several types of switches such as a selector switch, a joystick switch, a rotary switch, a toggle switch, or similar. In addition, although switch 100 shows a three-stage mating sequence, switch 100 may include more or fewer stages in the mating sequence and are intended to fall within the scope of the present disclosure.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents but also equivalent structures.

What is claimed is:

1. A switch comprising:

first, second, and third terminals;

an actuator configured to move among an OFF position, a transition position, and an ON position, wherein the transition position is between the OFF position and the ON position, wherein the actuator is in physical communication with the second terminal when in the OFF position, the actuator is in physical communication with the first and third terminals when in the transition position, and the actuator is in physical communication with the second and third terminals when in the ON position; and a resistor in physical communication with the first and second terminals, the resistor configured to limit an inrush current provided to components of an information handling system when the actuator enters the ON position, the resistor enables a limited amount of current to flow to the components of the information handling system when the actuator is in the transition position, wherein the limited amount of current provided while in the transition position limits the inrush current provided while in the ON position.

2. The switch of claim 1, further comprising a mechanical assertion mechanism to keep the actuator from staying in the transition position when moved from the OFF position to the ON position.

3. The switch of claim 1, wherein the first terminal is coupled to a first pin configured to receive input voltage.

4. The switch of claim 1, wherein the third terminal is coupled to a second pin configured to transmit output voltage.

5. The switch of claim 1, wherein the actuator is connected to a first moving contact and a second moving contact.

6. The switch of claim 5, wherein the first moving contact and the second moving contact are configured to engage with the first, the second and the third terminals.

7. The switch of claim 5, wherein the resistor is coupled in series between the first terminal and the second terminal.

8. A switch comprising:

first, second, and third terminals;

an actuator configured to move among from an OFF position to an ON position via a transition position, wherein the actuator is coupled with the second terminal when in the OFF position, the actuator is coupled with the first and third terminals when in the transition position, and the actuator is coupled with the second and third terminals when in the ON position; and a resistor in physical communication with the first and second terminals, the resistor configured to limit an inrush current provided to components of an information handling system when the actuator enters the ON position, the resistor enables a limited amount of current to flow to the components of the information handling system when the actuator is in the transition position, wherein the limited amount of current provided while in the transition position limits the inrush current provided while in the ON position.

9. The switch of claim 8, further comprising a mechanical assertion mechanism to keep the actuator from staying in a transition state when moved from the OFF position to the ON position.

10. The switch of claim 8, wherein the resistor is coupled in series between the first terminal and the second terminal.

11. The switch of claim 10, wherein the first terminal is coupled to a first pin configured to receive input voltage.

12. The switch of claim 8, wherein the third terminal is coupled to a second pin configured to transmit output voltage.

13. The switch of claim 8, wherein the actuator is connected to a sliding contact configured to couple with contacts of the first, the second, and the third terminals.

14. The switch of claim 13, wherein the transition position is between the OFF position and the ON position.

15. A switch comprising:

first, second, and third terminals;

an actuator configured to move from an OFF position then to a transition position and an ON position, wherein the actuator is in physical communication with the second terminal when in the OFF position, the actuator is in physical communication with the first and third terminals when in the transition position, and the actuator is in physical communication with the second and third terminals when in the ON position; and a resistor in physical communication with the first and second terminals, the resistor configured to limit an inrush current provided to components of an information handling system when the actuator enters the ON position, the resistor controls amount of current to flow to the components of the information handling system when the actuator is in the transition position.

16. The switch of claim 15, further comprising a mechanical assertion mechanism to assure that the actuator does not stay in the transition position when moving from the OFF position to the ON position.

17. The switch of claim 15, wherein the transition position is between the OFF position and the ON position.

18. The switch of claim 15, wherein a first end of the resistor is coupled to the first terminal and a second end of the resistor is coupled to the second terminal.

19. The switch of claim 18, wherein the first terminal is coupled to an input pin.

20. The switch of claim 15, wherein the third terminal is coupled to an output pin.

* * * * *